US008671596B2

(12) United States Patent
Manion

(10) Patent No.: US 8,671,596 B2
(45) Date of Patent: Mar. 18, 2014

(54) ULTRASONIC ICE SHAVING BLADE

(76) Inventor: Patrick R. Manion, Paradise Valley, AZ (US)

( * ) Notice: Subject to any disclaimer, the term of this patent is extended or adjusted under 35 U.S.C. 154(b) by 1073 days.

(21) Appl. No.: 12/180,515

(22) Filed: Jul. 25, 2008

(65) Prior Publication Data

US 2009/0188135 A1 Jul. 30, 2009

Related U.S. Application Data

(60) Provisional application No. 60/951,933, filed on Jul. 25, 2007.

(51) Int. Cl.
*E01H 4/00* (2006.01)

(52) U.S. Cl.
USPC ..... 37/219; 299/24

(58) Field of Classification Search
USPC ..... 37/219–224, 904; 299/24–27, 36–41; 426/238, 518, 660, 512
See application file for complete search history.

(56) References Cited

U.S. PATENT DOCUMENTS 3,622,205 A * 11/1971 Zamboni ..... 299/24
3,917,350 A * 11/1975 Bricher ..... 299/24
6,530,768 B1 * 3/2003 Harrop ..... 425/174.2
7,364,240 B2 * 4/2008 Seely ..... 299/24
7,510,247 B2 * 3/2009 Pirila ..... 299/1.5

* cited by examiner

*Primary Examiner* — Robert Pezzuto
(74) *Attorney, Agent, or Firm* — Hartman Titus PLC; Joseph W Matt

(57) ABSTRACT

An ice re-surfacing machine induces ultrasonic frequency vibrations onto the ice shaving blade. The vibrating blade can be pulled across the ice with less pressure and provides an improved finished surface.

14 Claims, 7 Drawing Sheets

ULTRASONIC ICE SHAVING BLADE

CROSS REFERENCE TO RELATED APPLICATIONS

This Application claims the benefit of priority of U.S. Provisional Application Ser. No. 60/951,933, filed Jul. 25, 2007.

BACKGROUND OF THE INVENTION

An ice re-surfacing machine for skating rinks and the like has two basic parts. The first is the main wheeled body driven over the ice, usually on standard rubber tires. The body generally includes motive power, an operator's seat and controls, a collection system and storage bin for ice cuttings, water tanks for the ice-washing and ice-making process, and a hydraulic arms system for carrying and positioning the ice re-surfacing apparatus.

The second part is the apparatus that re-surfaces the ice in a single pass. This structure, which is towed over the ice by the main body, is generally referred to as the "conditioner," but sometimes is called the "sled". The conditioner, carried at the back of the main body on hydraulically activated arms, is essentially an open-bottomed steel box that allows the re-surfacing components access to the ice surface when lowered into operating position and pulled across the ice. A runner and side plate on each side, parallel to the direction of travel, supports the conditioner in operation and confines the ice chips and water used in re-surfacing.

The majority of imperfections created in the ice surface by ice-skating are limited to one to two millimeters of ice depth. The conditioner holds a large blade, usually steel, that shaves a very thin layer off the ice surface. Generally, the blade is attached to a supporting draw bar, which is mounted to the conditioner frame.

Ice cuttings generated by the shaving blade must be removed from the surface as the blade is pulled along. Mounted forward of and parallel to the blade is a screw conveyor, variously known as a "horizontal conveyor" or "horizontal auger" or "horizontal screw." The horizontal conveyor comprises a cylindrical shaft onto which a helical flange, referred to as a "flight," is wound around and attached, similarly to the thread on a wood screw. The helical flight converts the rotational spin of the shaft into linear motion parallel to the shaft.

In most ice-resurfacing machines, the horizontal conveyor is configured so that flights on the left side move ice shavings from the outside toward the center of the conveyor, and flights on the right side move ice shavings from the outside toward the center as well. In the center of the horizontal conveyor, flat plates mounted parallel to the rotational axis of the shaft, called "paddles", connect to the left side and right side auger flights. The paddles are part of the "slinger", which transfers ice shavings to a vertical conveyor. In operation, the blade shaves the ice, creating particles that build up in front of the blade and are caught in the flights of the horizontal conveyor. The horizontal conveyor's rotating flights move the ice particles to the center, where the slinger throws them onto the vertical conveyor.

The vertical conveyor is designed to accept the stream of ice cuttings thrown from the slinger of the horizontal conveyor and move them upward for placing into the ice cuttings storage tank in the main body. The vertical conveyor is also a screw type conveyor, similar in design and function to the horizontal conveyor. All of the helical flights are wound around the central shaft in the same direction, imparting a continuous upward movement of ice cuttings from the bottom of the conveyor to the top. At the top, slinger paddles sweep the cuttings into the storage tank. The vertical conveyor is encased in a close fitting metal tube running the length of the auger. A lower aperture, facing the slinger of the horizontal conveyor, receives ice cuttings from the slinger, whereby the cuttings begin ascending on the flights. An aperture at the top faces the ice cuttings storage tank. The vertical conveyor slinger paddles throw the ice cuttings into the tank.

Behind the blade and draw bar is a wash water system that discharges cold water through a manifold that sits parallel to the blade. The wash water system includes a rubber squeegee mounted on the bottom of the back wall of the conditioner and a suction pump with an intake that projects nearly to the surface along that back wall. In operation, cold water from a tank in the main body is discharged onto the ice surface just behind the blade assembly, and is constrained by the side runners and the squeegee as the machine moves forward. By regulating the flow of water and the suction of the collection pump, the operator maintains a wash water pool of constant size behind the blade assembly. This moving pool floats contaminants off the ice surface and floods any deep grooves and pits in the ice surface, then is collected and returned to the water tank.

The last part of the conditioner is the ice maker, mounted to the back wall of the conditioner. A discharge manifold sprays multiple small jets of hot water from a tank in the main body onto the outside back wall of the conditioner, where it forms a continuous sheet of water cascading down onto the ice across the conditioner's entire width. Finally a cloth water spreader, called a "mop", evenly spreads and polishes the ice making water into a smooth surface.

Conventional ice re-surfacing machines shave the ice by forcing a blade forward through the ice as the machine travels forward. The cutting edge must part the ice on its cutting plane by brute pressure alone. Since ice is very hard, blades dull rapidly. Also, because the high cutting pressure strongly opposes the forward motion of the blade, strong propulsion and guiding forces are required to push the blade downward as well as forward. The present invention employs ultrasonic vibration of the blade to reduce the pressure required to force the blade through the ice and improve the quality of the ice cut.

SUMMARY OF THE INVENTION

The ice resurfacing machine of the present invention applies ultrasonic frequency vibration to the ice cutting blade. In one embodiment, piezoelectric transducers, driven by an ultrasonic frequency generator, are mounted to the blade or the draw bar. The vibrating cutting edge causes microscopic splits and fractures in the ice, softening the ice just forward of the blade. The cutting edge of the blade moves forward and backward with each vibration cycle, causing the blade to cut the ice in tightly controlled, chopping pulses tens of thousands of times per second.

DRAWINGS

DETAILED DESCRIPTION

Figure 1:
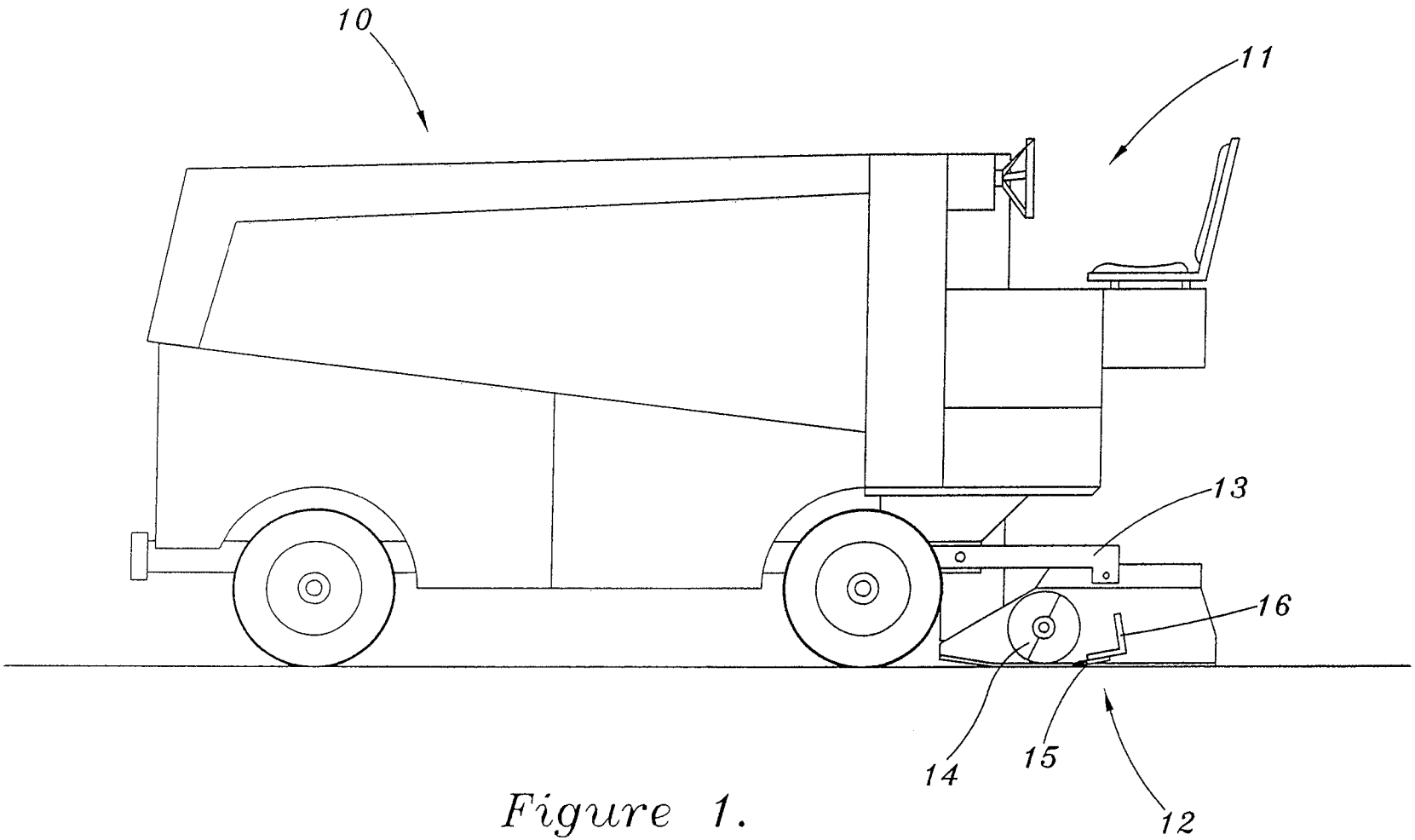
FIG. 1 is a schematic of an ice resurfacing machine.

A schematic of a standard ice resurfacing machine is shown in FIG. 1. Main body (10) encloses an internal combustion motor or electric motor for propelling the unit and powering other components. It also encloses a storage tank for ice shavings, tanks for wash water and ice making water, and an operator's seat and controls (11). The sled or conditioner (12) is attached to main body (10) by hydraulic arms (13).

FIG. 1 shows only some of the components of conditioner (12). A horizontal conveyor (14) for moving ice shavings to the center and throwing them onto a vertical conveyor is placed forward of shaving blade (15) mounted to draw bar (16). Remaining elements of the conditioner are not shown.

Figure 2:
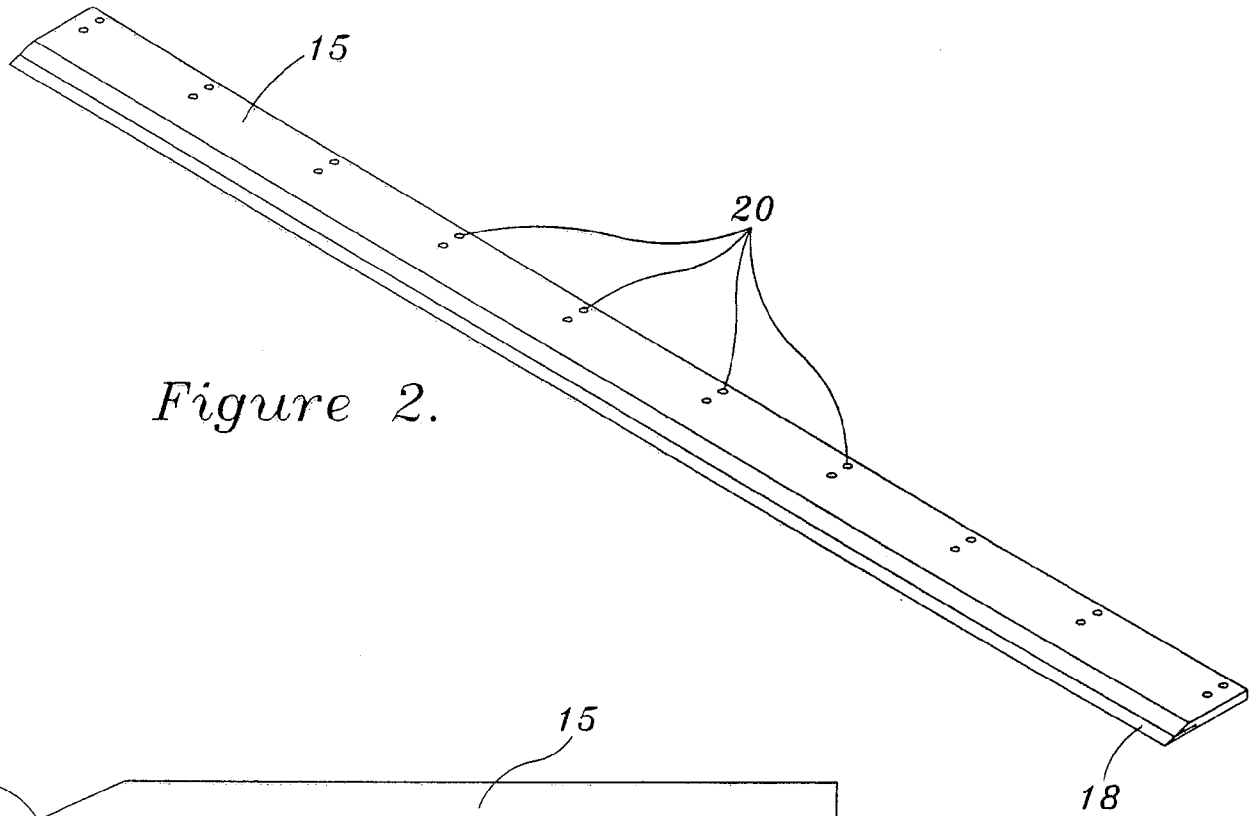
FIG. 2 is a perspective view of an ice shaving blade.
Figure 3:
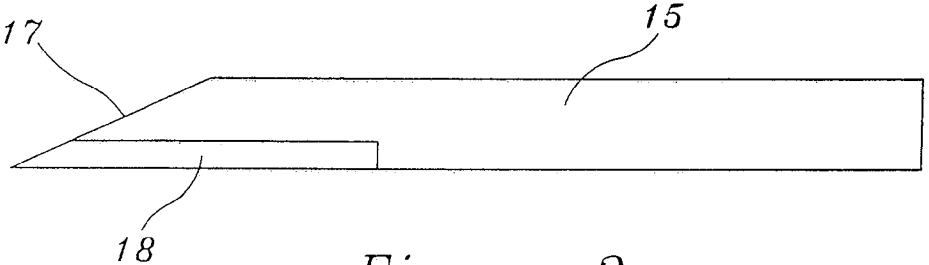
FIG. 3 is an end view of the blade of FIG. 2.

A conventional ice shaving blade is shown in FIGS. 2 and 3. Typical cutting blades are made of carbon steel in a shape approximately that of a disposable razor blades only much larger. The standard blade on the most used machine in the United States is made from a steel rectangle 77 in (1956 mm) by 5 in (127 mm) by one-half inch (13 mm). Depending on the brand and model of machine, blades used in North America include 48, 77, 80, 88 and 96 inch (1219, 1956, 2032, 2235 and 2438 mm) lengths.

Blade (15) has a cutting edge (17) machined into its forward edge at an angle of about 25 degrees. Insert (18) made of hardened tool steel is forged into the body of blade (15), enabling the blade to hold a sharp edge much longer than carbon steel would. Carbon steel with the needed dimensions is too flexible to maintain a flat and even cut along the ice surface, however, and the blade is typically mounted to a heavy steel draw bar.

Figure 4:
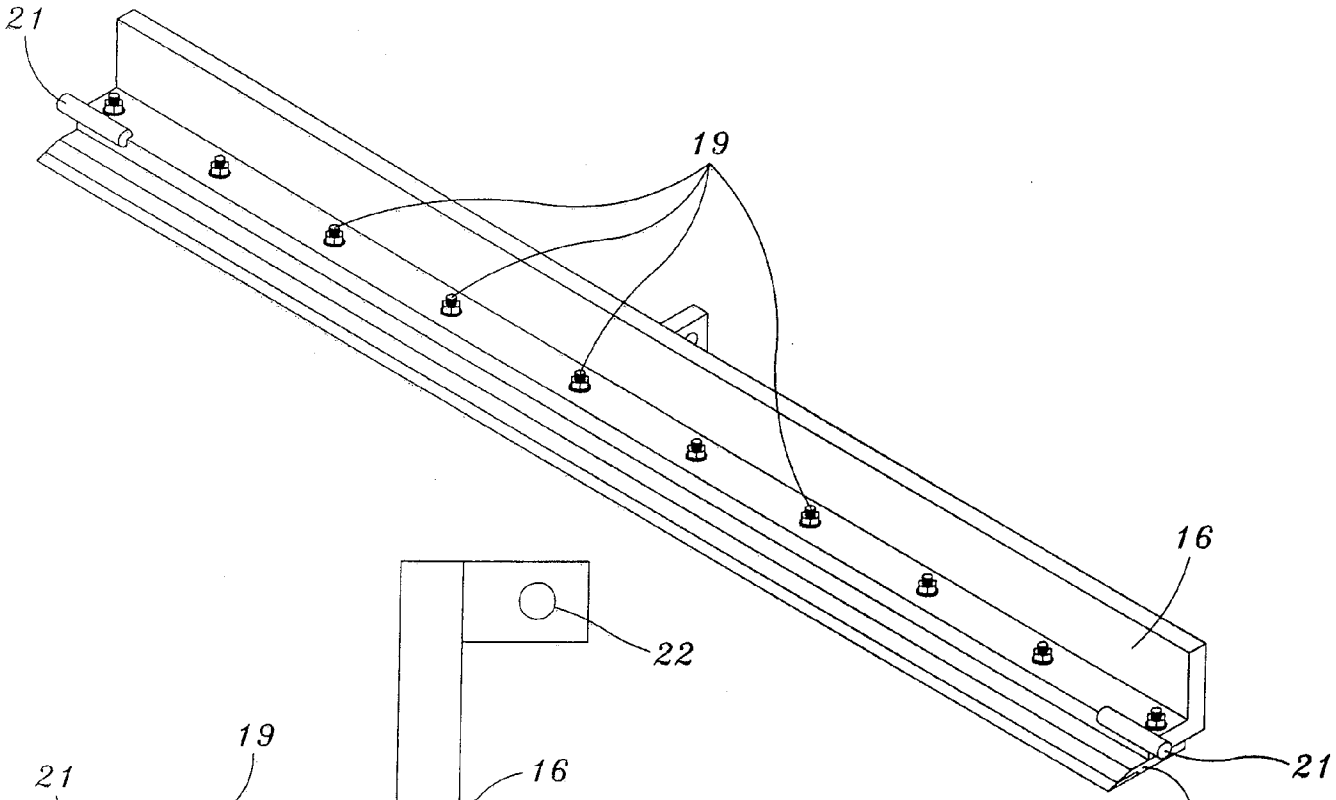
FIG. 4 is a perspective view of an ice shaving blade mounted to a draw bar and conveyor.
Figure 5:
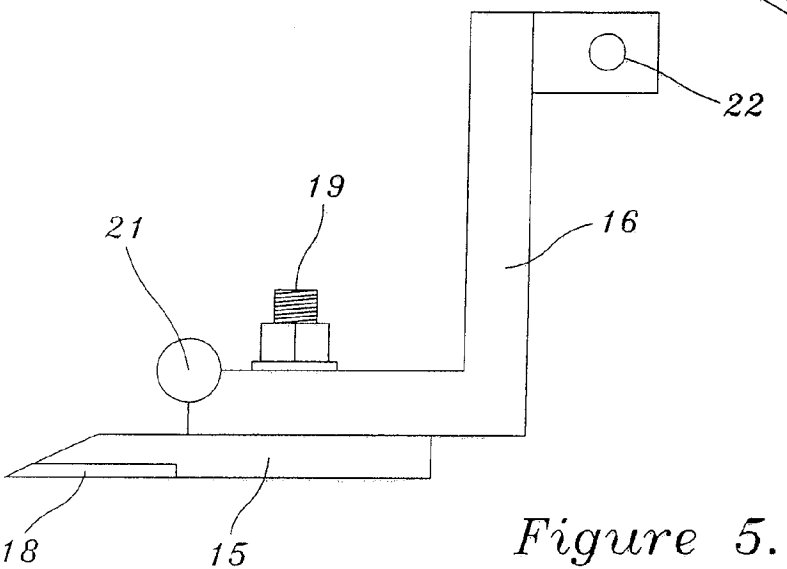
FIG. 5 is an end view of the blade and draw bar of FIG. 4.

As seen in FIGS. 4 and 5, draw bar (16) is a heavy steel bar the same length as blade (15), with an L-shaped cross section for rigidity. Blade (15) is firmly attached under the draw bar with bolts (19) passing through spaced apertures (20) in the blade. Draw bar mounting pins (21) pivotably attach the draw bar to the opposite sides of the conditioner enclosure. Blade pitch control mounting point (22) at the center of the rear plate of the draw bar enables the operator to set the angle at which the blade contacts the ice surface.

The present invention improves the performance of the ice shaving blade by inducing high-frequency vibrations in the blade during shaving operations. The vibration frequency is preferably in the ultrasonic range of 20,000 to 100,000 Hertz, which provides high motion cycling with less energy dissipation into heat that is characteristic of higher frequency vibrations. Various known types of transducers may be employed to impart the high frequency vibrations. In one embodiment, solid state piezoelectric transducers are attached for this purpose. Piezoelectric transducers are available in a variety of shapes, sizes and operational characteristics.

Figure 7:
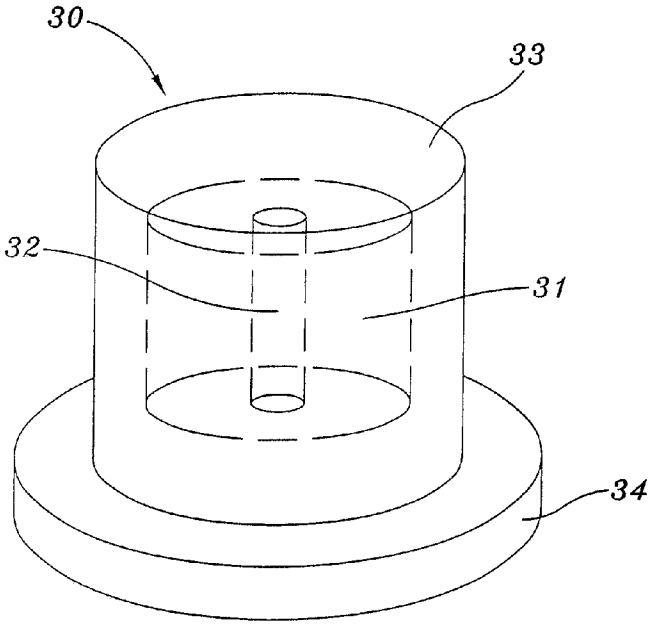
FIG. 7 is a schematic of the transducer element of FIG. 6 in a protective casing.
Figure 6:
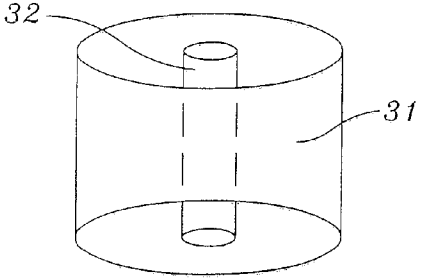
FIG. 6 is a schematic of a transducer element used in an embodiment of the present invention.

FIG. 6 illustrates a transducer used in one embodiment. Element (31) is a cylinder of piezoelectric material having a center bore (32) for attaching to the unit. Because the environment where the transducer is used includes stray ice shavings, water, and cold, it is helpful to encase the piezoelectric element in a protective cover. FIG. 7 illustrates one embodiment of the transducer unit. Cover (33) is a protective hollow cylinder, open at one end, that fits over cylindrical element (31). Transducer element (31) is attached to base (34) in a way that efficiently transfers vibrations to the base.

Figure 8:
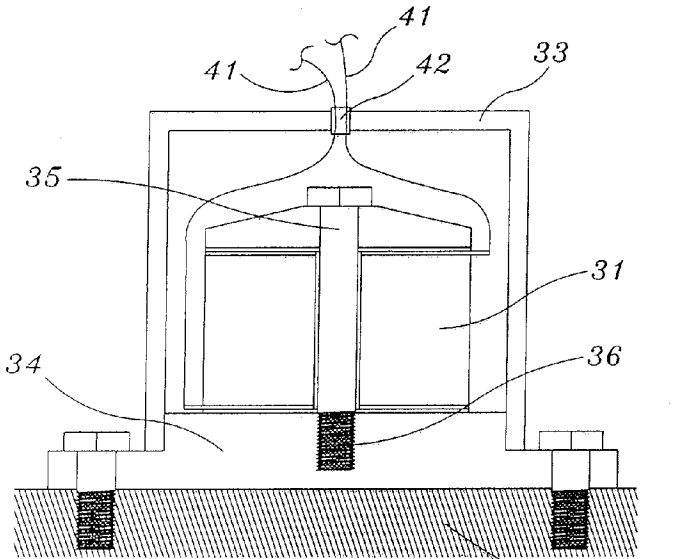
FIG. 8 is a schematic of a transducer assembly mounted to a draw bar.

FIG. 8 is a more detailed view of the mounted transducer unit. Piezoelectric element (31) is enclosed in cover (33). Mounting bolt (35) through center bore (32) fits into a threaded receptacle (36) in base (34). The transducer is firmly attached to the base for sonic vibration conductivity. Transducer assembly (30) is firmly attached for sonic vibration transmittal to the blade assembly (15). In one embodiment, the transducer is mounted on the rear face of the draw bar (16) to which the blade is attached. The carbon steel material commonly used in draw bars is an excellent ultrasound vibration conductor, as is the steel used in shaving blades. Thus, the transducer is sonically coupled (i.e., ultrasonic vibrations are efficiently transmitted) to the blade. Conducting wires (41) are attached to contact points on the transducer. Conducting wires (41) pass through a hermetic seal in an aperture (42) in the cover. Wires (41) connect to a signal generator for the transducer.

Figure 9:
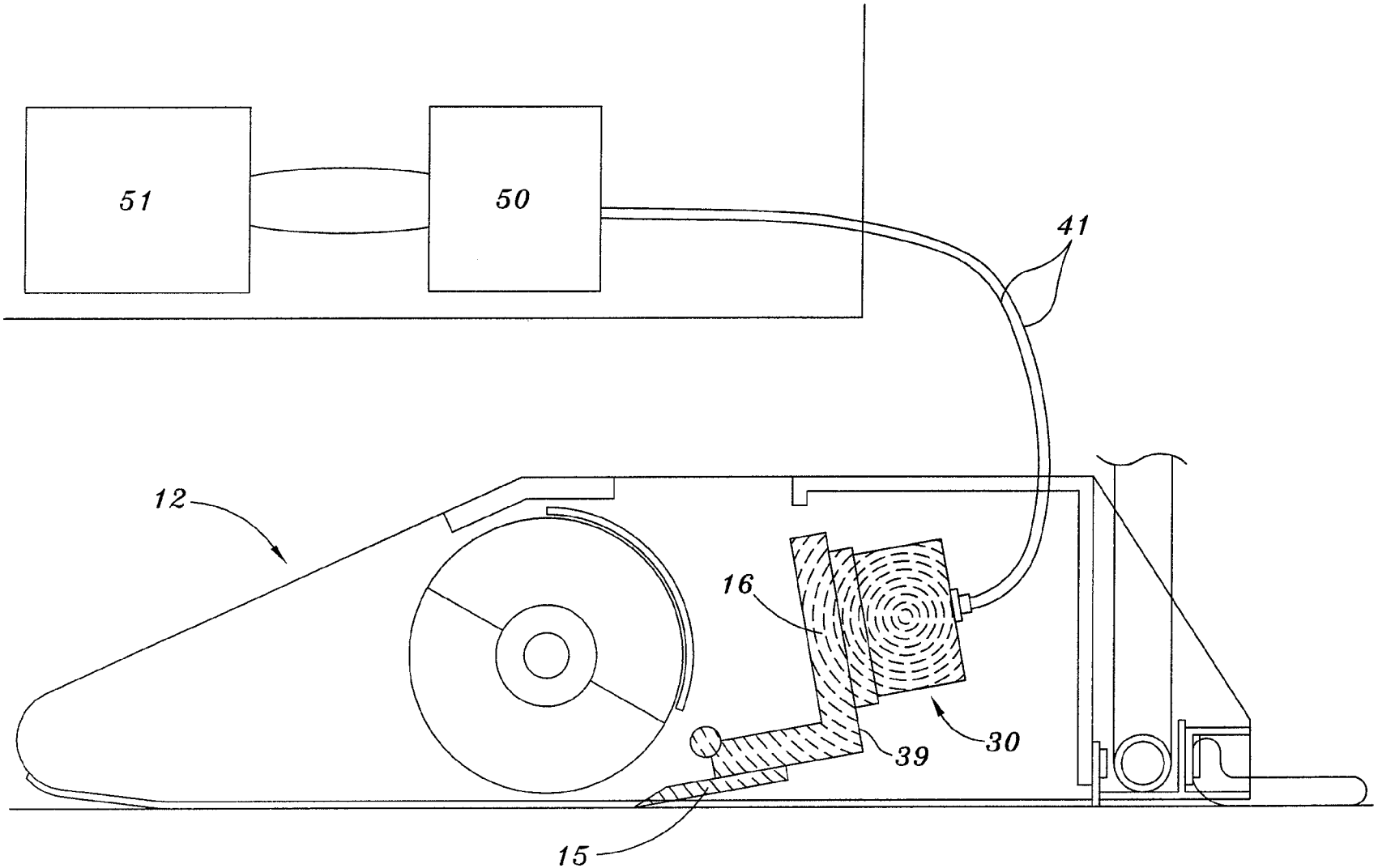
FIG. 9 is a schematic of an embodiment of the present invention.

FIG. 9 shows a side view of a transducer in place within a conditioner (12). Transducer assembly (30) is mounted to rear surface (39) of draw bar (16). Blade (15) is mounted to draw bar (16) in a conventional manner. Electrical leads (41) pass out of the cover of the transducer and are connected to an ultrasonic frequency generator (50) mounted in a housing in the main body of the ice re-surfacing machine. The wash water operation is conducted behind and below the position of the transducer.

Vibration of the transducer is instigated and controlled by a standard ultrasonic frequency generator (50), which preferably is variably controlled, inside the main housing. The frequency generator is connected to a power source (51) which may be a battery or a generator associated with the drive engine. Control functions may be located within reach of the operator. A safety mechanism that turns off the vibrator when the blade is not in operating position is desirable.

Preferably, the system will produce ultrasonic vibration of the blade assembly in the most energy efficient way possible. The ideal vibrational frequency for use with a specific blade/draw bar assembly will depend on the assembly's weight and shape. The blade/draw bar assembly weight and shape is model specific and different for each manufacturer. So the ideal vibrational frequency for a specific model of machine will be determined experimentally.

Figure 10:
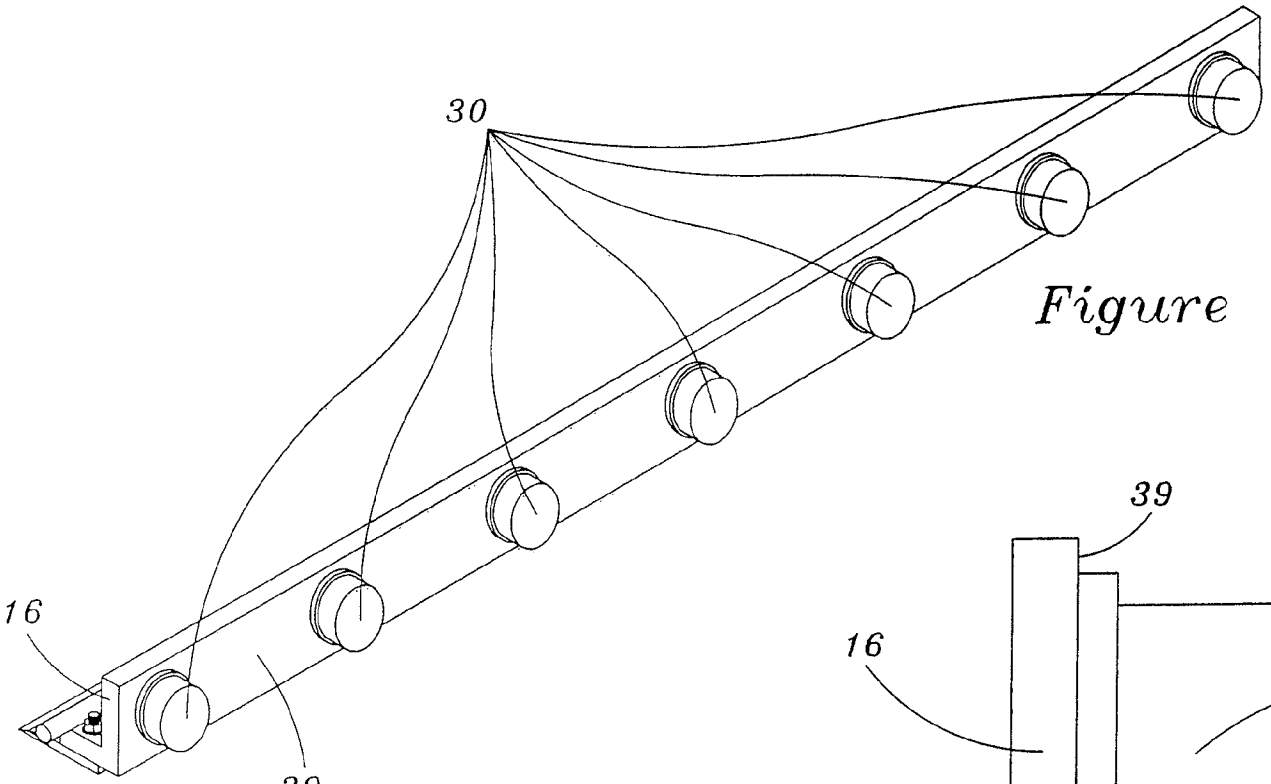
FIG. 10 is a schematic of another embodiment of the present invention.
Figure 11:
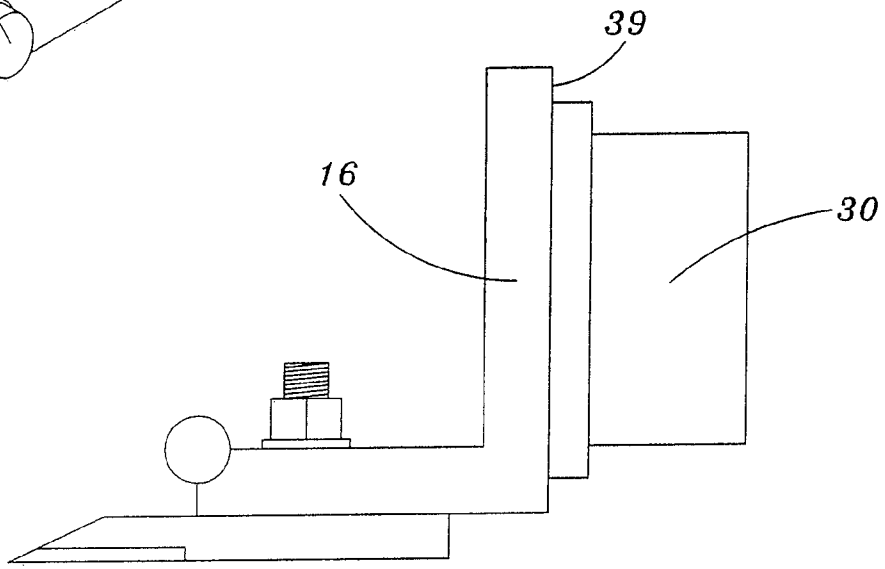
FIG. 11 is an end view of the embodiment of FIG. 10.
Figure 12:
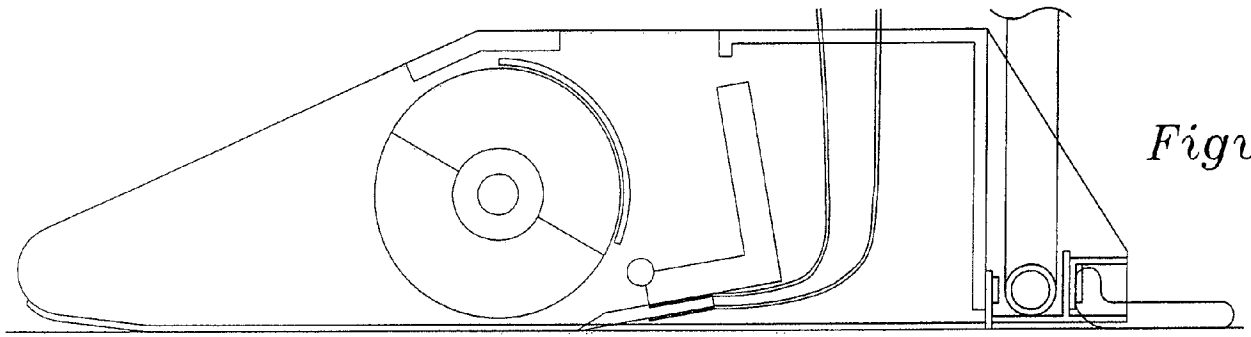
FIG. 12 is a schematic of another embodiment of the present invention.
Figure 13:
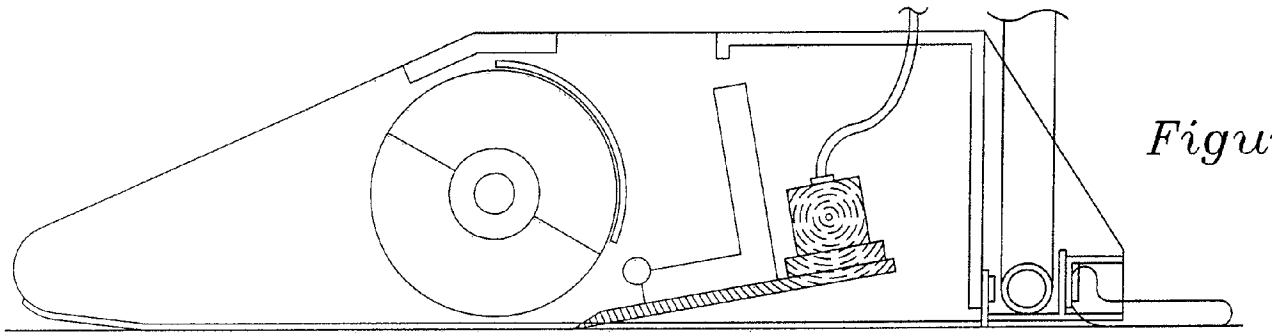
FIG. 13 is a schematic of another embodiment of the present invention.
Figure 14:
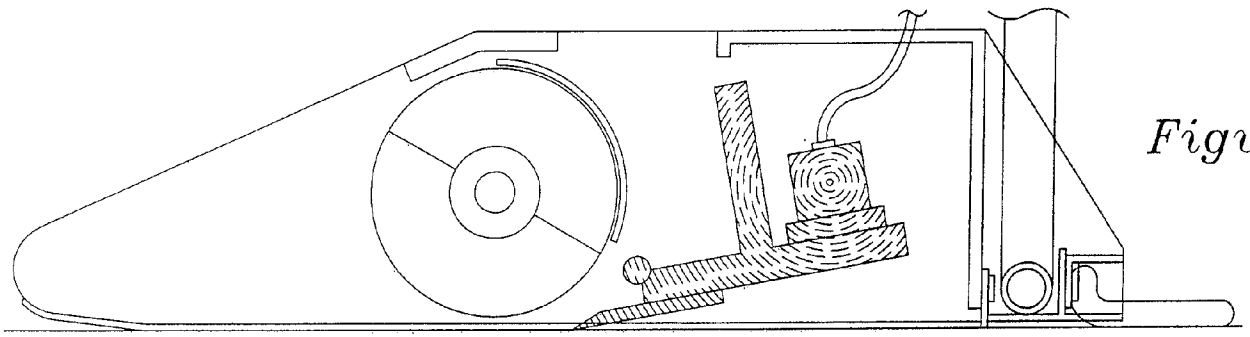
FIG. 14 is a schematic of another embodiment of the present invention.

Vibration may be imparted in the shaving blade by a single transducer or by a plurality of transducers as shown, for example, in FIG. 10. While mounting the transducer to the back of the draw bar is preferred, other configurations are possible. For example, thin transducer elements could be mounted above or below the blade body as shown in FIG. 12. A wide blade rectangle, protruding beyond the draw bar, could provide a platform for direct contact between the blade and the transducer, as shown in FIG. 13. A T-shaped draw bar (rather than L-shaped) would hold the blade and the transducer on its approximately horizontal base, as in FIG. 14.

The configuration and materials common in current ice re-surfacing machines are generally well-suited to application of the inventive concept. Ice shaving blades and draw bars are made of steel that is a good transmitter of the desired vibrations to the cutting edge, and they are tightly bound together so vibration energy readily passes from the draw bar to the blade. Connection of the draw bar to the conditioner frame with mounting pins generally isolates the dissipation of vibration energy to the conditioner frame. Depending upon a particular machine's specific configuration, sound isolating materials or lubrications may advantageously be applied at the connection point between the draw bar and the conditioner frame.

The invention is also suitable as a retrofit modification for existing ice resurfacing machines, on which draw bars and shaving blades are removable and replaceable. A new draw bar or blade with transducers can easily be inserted into the conditioner, and available signal generators are compact enough to be placed somewhere in the main body housing with wire connectors to the transducers. Alternately, a kit of one or more transducers may be affixed to the existing draw bar, with wires run to the signal generator.

The foregoing description of a preferred embodiment of the invention has been presented and is intended for the purposes of illustration and description. It is not intended to be exhaustive nor limit the invention to the precise form disclosed and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated. Therefore, it is intended that the invention not be limited to the particular embodiments disclosed for carrying out the invention.

What is claimed is:

1. An ice resurfacing machine for smoothing an ice surface of an ice rink, having an ice shaving blade, positioned to remove a top layer of the ice surface as the machine moves across the ice surface, that vibrates with ultrasonic vibrations.

2. The machine of claim 1 including at least one ultrasonic transducer coupled to the blade to induce vibrations in the blade.

3. The machine of claim 2 wherein the blade is attached to a draw bar and the transducer is coupled to a rear surface of the draw bar.

4. The machine of claim 3 wherein the transducer comprises a piezoelectric element.

5. The machine of claim 4 wherein the transducer further comprises a protective cover and the transducer is electrically coupled to an ultrasonic signal generator.

6. The machine of claim 1 further including a plurality of ultrasonic transducers coupled to the blade.

7. The machine of claim 6 wherein the blade is attached to a draw bar and the transducers are coupled to a rear surface of the draw bar.

8. The machine of claim 7 wherein the transducers comprise piezoelectric elements.

9. The machine of claim 8 wherein each transducer further comprises a protective cover and the transducers are electrically coupled to an ultrasonic signal generator.

10. A method of resurfacing ice comprising the steps of driving an ice resurfacing machine over the ice and dragging an ultrasonically vibrating ice shaving blade across the surface.

11. The method of claim 10 wherein the ice shaving blade comprises a blade coupled to at least one piezoelectric transducer driven by an ultrasonic generator.

12. A kit for improving the ice shaving operation of an ice resurfacing machine for smoothing the surface of an ice rink, comprising at least one ultrasonic transducer adapted to be coupled to and induce vibrations in an ice shaving blade in the machine.

13. The kit of claim 12 wherein the at least one transducer compromises a piezoelectric transducer element with a protective cover and further comprising an ultrasonic signal generator connected to the transducer and adapted to fit on a main body of the machine.

14. The kit of claim 13 wherein the at least one transducer is coupled to a draw bar adapted to replace an existing draw bar in the machine.

* * * * *